United States Patent [19]

Rovacchi

[11] Patent Number: 4,730,352

[45] Date of Patent: Mar. 8, 1988

[54] SUPPLY CIRCUIT FOR AN X-RAY EMITTER USABLE IN RADIOLOGY

[75] Inventor: Roberto Rovacchi, Monza Italie, Italy

[73] Assignee: Thomson-CGR, Paris, France

[21] Appl. No.: 774,722

[22] Filed: Sep. 11, 1985

[30] Foreign Application Priority Data

Sep. 14, 1984 [FR] France ..... 84 14153

[51] Int. Cl.[4] ..... H05G 1/10; H05G 1/56

[52] U.S. Cl. ..... 378/101; 378/114; 363/85; 363/129

[58] Field of Search ..... 378/101–104, 378/114; 363/85–87, 89, 129, 124; 323/237, 320, 209–211; 307/252 M

[56] References Cited

U.S. PATENT DOCUMENTS

| | | | |
|---|---|---|---|
| 3,720,868 | 3/1973 | Lee | 363/89 |
| 4,168,436 | 9/1979 | Aradate et al. | 378/101 |
| 4,200,795 | 4/1980 | Kawamura et al. | 378/101 |

FOREIGN PATENT DOCUMENTS

| | | | |
|---|---|---|---|
| 2608243 | 9/1977 | Fed. Rep. of Germany . | |
| 2804591 | 8/1979 | Fed. Rep. of Germany . | |
| 2389294 | 11/1978 | France . | |
| 2481046 | 10/1981 | France . | |
| 0892612 | 12/1981 | U.S.S.R. | 363/124 |
| 0957434 | 9/1982 | U.S.S.R. | 363/124 |

*Primary Examiner*—Craig E. Church
*Assistant Examiner*—John C. Freeman
*Attorney, Agent, or Firm*—Oblon, Fisher, Spivak, McClelland & Maier

[57] ABSTRACT

The invention relates to a supply circuit for an X-ray emitter usable in radiology. The circuit has a transformer, whereof the primary is connected to the three-phase power supply and whereof the secondary is connected to the X-ray emitter. The primary circuit is put into operation by the closing of a controlled switch. This switch has a set of closing thyristors. The switch also has a correctly charged capacitor connectable to the set of thyristors. For opening the circuit, the capacitor is connected in such a way that it supplies a reverse current to the thyristors of the set of thyristors. Thus the capacitor is recharged with the reverse polarity. During a following closing - opening sequence of the switch, the terminals of the capacitor are connected to the set of thyristors by switching their connection. In this way, the capacitor is always correctly connected for fulfilling its function during the blocking of the thyristors.

8 Claims, 5 Drawing Figures

FIG_2-a
x
9
10
11
14
1
2
3
4
5
6
7
8
12
13
20
21
50
A
B
$V_{AB}$
$V_R$
$\Delta V$
t
$t_1$
$t_2$
$t_3$
$t_4$
$t_5$ FIG_2-b
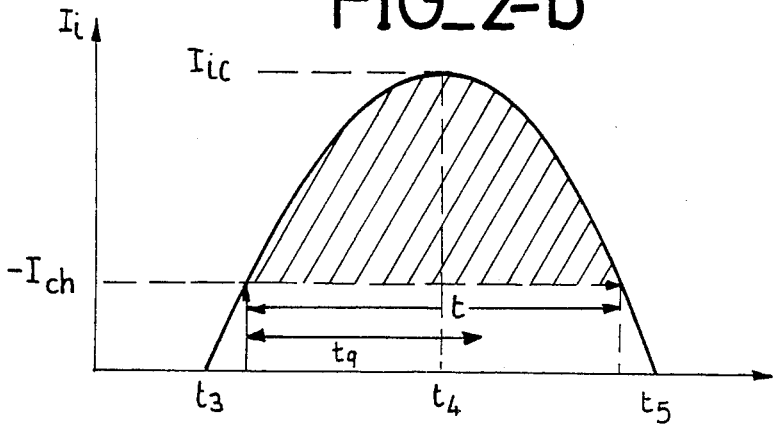
FIG_3
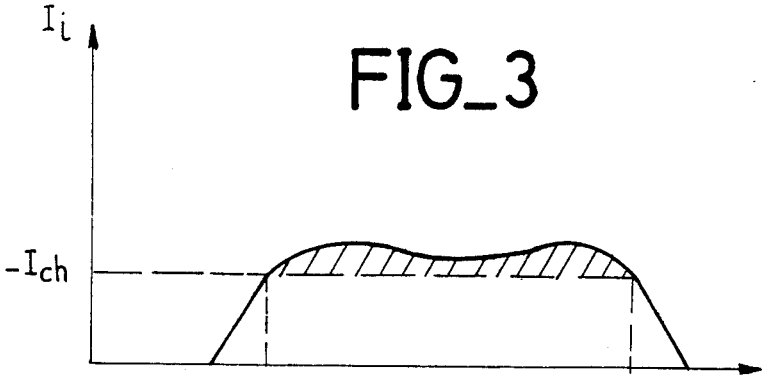
FIG_4
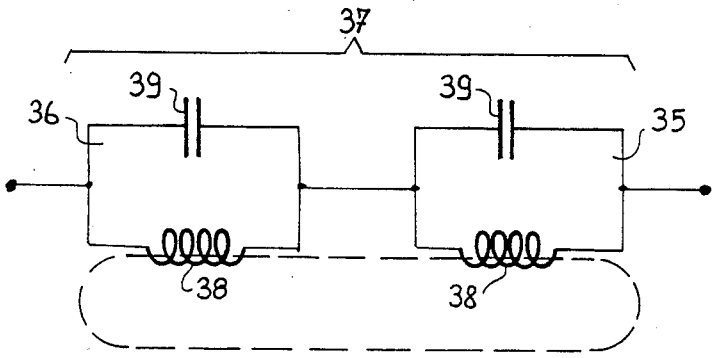

SUPPLY CIRCUIT FOR AN X-RAY EMITTER USABLE IN RADIOLOGY

BACKGROUND OF THE INVENTION

1. Field of the Invention

The present invention relates to a supply circuit for an X-ray emitter usable in radiology. In radiology, it is necessary to supply an X-ray source or emitter for a predetermined time. This time corresponds to the exposure time of a radiosensitive plate. In cineradiology, it is also necessary to modify the activity of the X-ray emitter as a function of the timing of recording, so that the radiation dose received by a patient is reduced during such an examination.

2. Description of the Prior Art

Conventionally, the supply circuit for the emitter comprises a transformer, whose primary circuit is connected to a three-phase alternating current network and whose secondary circuit is connected to the emitter. The primary circuit connected in star-like manner has, in place of a nodal connection, a switch for connecting together the three supply conductors to the nodal point. The time during which this switch is closed conditions the putting into operation of the primary and consequently that of the transformer and consequently fixes the activity period of the X-ray emitter. The switch is conventionally provided with a set of thyristors, which are fired during the desired energization. In order to obtain an opening of the switch, the turning off of the thyristors is brought about. For this purpose there is a quantity of electrical energy contained in a previously charged capacitor and which is reverse discharged into the thyristors. When the value of this reverse current exceeds the value of the charging current of said thyristors, the latter are deenergized and are blocked.

Before starting a further firing - turning off cycle of the set of thyristors in question, it is necessary to recharge the blocking capacitor. The duration of this supplementary sequence prevents the repetition of the operating cycle at a high speed, e.g. 50 cycles per second, as used in cineradiography. Moreover, the recharging of the capacitor makes it necessary to provide a supplementary power supply. Finally, during the discharge of the blocking capacitor, the reverse current established in the set of thyristors has a sinusoidal configuration, i.e. it increases up to a maximum and then decreases. In order to block the thyristors, an adequate reverse current must be established there for a time exceeding their covering or overlap time, which leads to the choice of high value capacitors. Thus, the useful duration of the adequate reverse current increases in proportion to the maximum intensity of said reverse current. The latter is dependent on the capacitance of the capacitor. This means that at the strong time of the blocking operation, the thyristors are traversed by a needlessly high current, because it is mainly their overlap or covering time which controls their blocking.

SUMMARY OF THE INVENTION

The present invention aims at obviating the aforementioned disadvantages. It makes it possible to achieve a high speed by using a circuit not requiring a special sequence for recharging the capacitor. Thus, during blocking, the discharge of the capacitor leads to its recharging with reverse polarity. The invention proposes that for the following cycle the terminals of the capacitor are switched in such a way that, without changing the polarity of said capacitor, the latter becomes correctly connected again.

Thus, the present invention specifically relates to a supply circuit for an X-ray emitter usable in radiology, of the type incorporating a transformer, whereof the primary circuit is connected to the three-phase power supply and whereof the secondary circuit is connected to the emitter, in which the primary circuit is placed in and out of operation by a controlled switch, said switch having a set of closing thyristors for closing the primary circuit and consequently put into operation the supply circuit, as well as a correctly charged capacitor connectable to said primary circuit for reversing the flow direction of the current into the set of closing thyristors, in order in this way to open the switch and consequently stop the supply, wherein, it also comprises a circuit for switching the connection of the capacitor to said primary circuit.

BRIEF SUMMARY OF THE DRAWINGS

The invention is described in greater detail hereinafter relative to a non-limitative embodiment and the attached drawings, wherein show.

Figure 1:
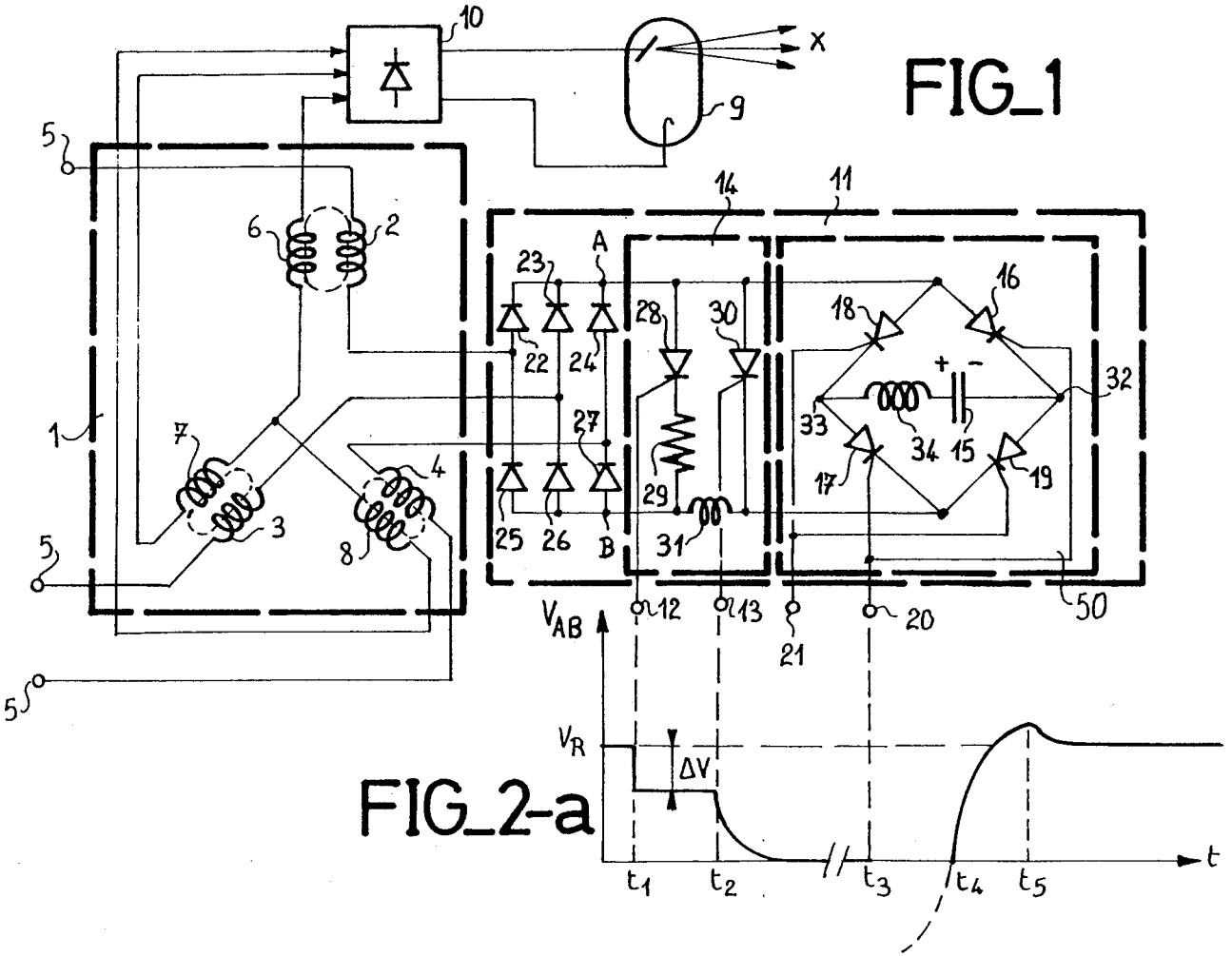
FIG. 1: A general diagram of a supply circuit according to the invention.

FIGS. *2a* and *2b:* Waveshapes at different locations of the preceding circuit.

FIG. 3: A variant of the waveshape caused by a particular blocking circuit.

FIG. 4: The blocking circuit in question.

DESCRIPTION OF THE PREFERRED EMBODIMENT OF THE INVENTION

FIG. 1 shows a supply circuit according to the invention comprising a transformer 1, whose primary circuit 2, 3, 4 is connected to the three-phase power supply 5. The secondary circuit 6, 7, 8 of said transformer is connected to an X-ray emitter 9. The connection of said secondary circuit has a current rectifier 10. The primary circuit is put into operation by means of a switch 11, which receives its control or command on two input terminals 12, 13. This switch has a set 14 of thyristors ensuring the closing of the switch whilst virtually short-circuiting points A and B of said switch. Switch 11 also has a correctly charged capacitor 15 connectable to the primary circuit for reversing the direction of passage of the current into the set 14 of thyristors. When the current in the thyristors is reversed, they are turned off and reestablish the opening of the circuit between switch points A and B. Under these conditions, the primary no longer supplies and the X-ray emitter 9 can no longer emit. What characterizes the invention is that capacitor 15 is connected to the thyristor set 14 by a switching circuit 50 having thyristors 16 to 19. These thyristors are controlled in pairs (16–17 and 18–19) by the common control terminals respectively 20, 21. By selecting one or other of said terminals, it is possible to reverse the connection direction of the capacitor to set 14.

Windings 2, 3, and 4 are the three primary windings of the three-phase transformer. They are magnetically coupled to the three secondary windings of transformer 1. On the opposite side to the three-phase power supply, windings 2, 3 and 4 are connected to six diodes 22 to 27. Each end of each of the windings is connected to the centre respectively of the series-connected diode pairs 25–22, 26–23, and 27–24. The three pairs are connected in parallel between switch points A and B. For putting the primary into operation, it is merely necessary to short-circuit point A, connected in common to the three cathodes of diodes 22 to 24, to point B connected in common to the three anodes of diodes 25 to 27. When the circuit is open, the d.c. voltage $V_R$ between points A and B is equal to $\sqrt{2}$ times the voltage distributed by power supply or network 5. To ensure that the putting into operation of the primary does not lead to overvoltages at the secondary, the connection of point A to point B takes place in two periods.

In the set of thyristors 14, a thyristor 28 is first opened at a time $t_1$ (FIG. 2*a*) by delivering a short-duration pulse to its gate by control terminal 12. A resistor 29 connected in series with thyristor 28 leads to a voltage drop $\Delta V$, which is also represented in FIG. 2*a*. Then at the end of a short time (the time separating $t_2$ from $t_1$), a main thyristor 30 is fired by a short pulse applied to its control terminal 13. The two thyristors 28, 30 are connected in parallel between points A and B, the first via resistor 29 in series and the second via a choke 31 in series. Choke 31 limits the current variation in such a way that voltage $V_{AB}$ then tends exponentially towards zero (FIG. 2*a*). The transformer is then energized. In radiology, this constitutes the start of exposure. Bearing in mind the fact that thyristor 30 is conductive, thyristor 28 in series with resistor 29 is naturally blocked or rendered non-conductive. The current liable to pass there is below its holding current.

In order to bring about the deenergization of transformer, the forced turning off of thyristor 30 is brought about. The electrical energy in capacitor 15 is used for this purpose. According to the invention, capacitor 15 is connected between the two centres 32, 33 of a switch bridge having two branches in parallel. A first branch has thyristor 16 and 19 in series with one another and the second branch has thyristors 18, 17 also in series with one another. The common ends of these two branches are connected in parallel to the terminals of thyristor 30.

Assuming that capacitor 15 is in the electrical state shown in FIG. 1, namely its armature or foil close to terminal 3 is positively charged with respect to its other armature or foil. In order to energize the supply circuit, at $t_3$ thyristors 16 and 17 are fired by a short pulse applied to their common control terminal 20, whilst thyristors 18 and 19 remain blocked. During this firing, capacitor 15 is discharged passing through a choke 34 connected in series therewith between points 32 and 33. Current passes through choke 34 and starts to travel in the opposite direction to the normal current in thyristor 30. During the exposure time, a charging current of intensity $I_{ch}$ flows into thyristor 30. At time $t_3$, a reverse current of value $I_i$ starts to flow into thyristor 30. The configuration of this current as a function of time is shown in FIG. 2*b*. Due to the presence of choke 34 current $I_i$ has a sinusoidal configuration. However, only a single alternation or cycle (positive alternation) can pass due to thyristors 16, 17. As soon as current $I_i$ exceeds, in absolute value, current $I_{ch}$, thyristor 30 starts to block. For the blocking of thyristor 30 to be effective, it is necessary for the reverse current to exceed the charging current for a time t exceeding an overlap or covering time $t_q$ characteristic of the thyristor 30 used.

The reverse current takes a circuit passing through thyristor 16, capacitor 15, choke 34, thyristor 17 and thyristor 30. After time $t_q$, the capacitor discharge current "tail" passes through the circuit of diodes 22 to 27 and is closed on capacitor 15. Towards the end of the half-alternation or cycle, the reverse current is cancelled out and cannot become negative as a result of the presence of thyristors 16, 17 and diodes 22 to 27. During the opening phase, the discharge current recharges capacitor 15 in the reverse direction. Finally, the recharging current is cancelled out, the circuit opens between points A and B and capacitor 15 is charged in reverse direction to a voltage above the peak of the mains voltage, as a result of the presence of stray inductors of the transformer. Thus, and this is an important advantage of the invention, the energy contained in said stray inductors, at the time of blocking, is applied to capacitor 15. It is for this reason that the voltage $V_{AB}$ in FIG. 2 assumes during blocking at $t_5$ a value exceeding the voltage $V_R$ under steady state conditions between points A and B. At terminals A and B said overvoltage drops again to return to the normal value under steady state conditions when switch 11 is open. However, at the terminals of capacitor 15 the overvoltage has not been able to decrease in the limits of the leakage time of capacitor 15. Thus, thyristor 16 is then negatively biased and does not permit the discharge of capacitor 15. This decrease of potential $V_{AB}$ following the overvoltage is also the reason for the natural blocking of thyristor 16, 17. The blocking thereof is also reinforced by the fact that at this time current $T_i$ is low and consequently below the holding current thereof.

The charging polarity of capacitor 15 is consequently now the reverse of that shown in FIG. 1. At the next energizing which it is wished to carry out, it is not the thyristors 16 and 17 accessible by terminal 20 which will be involved, but thyristors 18 and 19 by supplying a short electric pulse to their common control terminal 21. In the invention the capacitor, which has been reverse charged by the current used for turning off thyristor 30, will then retain the polarity which it has. Terminals 32, 33 of said capacitor will be switched, so that their connections to thyristor 30 will be the reverse of those previously. In other words, in the invention it is not necessary to provide a special sequence for restoring the capacitor to an initial single state.

During a first putting into operation of the supply circuit or after an excessive time between two operational states, capacitor 15 is generally discharged. It must then be given a good starting charge. To this end, thyristors 18 and 19 are fired beforehand. Voltage $V_R$ is applied to the terminals of the capacitor 15, which are charged as shown in FIG. 1. Following the first closing of the primary circuit, the opening is controlled by the firing of thyristors 16, 17. Following the following closure, the opening is controlled by the firing of thyristors 18, 19 and so on. If these successive operations are sufficiently close to one another, particularly in the case of cineradiography, capacitor 15 does not have time to discharge and the switching circuit operates normally. Thus, the invention bring about the two expected advantages, namely a saving in time by eliminating the capacitor recharging sequence and a technological gain by elimiinating the power supply for supplying an energy compliment to the capacitors.

The invention also has another feature. In order to bring about the deenergization of thyristor 30, it is necessary to supply in reverse thereto a current exceeding its direct charging current for a time exceeding its overlap time $t_q$. This reverse current is supplied by discharging capacitor 15. When the discharging circuit has a choke 34 as shown in FIG. 1, the shape of the discharging current is as shown in FIG. 2*b*. The condition indicated hereinbefore can lead to a high reverse peak current $I_{ic}$. However, on replacing the capacitor - inductor pair 15-34 by a group of cells L-C, shown in exemplified manner in FIG. 4, a discharge pulse is obtained with the shape shown in FIG. 3. Each of the cells 35 or 36 of assembly 37 has a choke 38 in parallel with a capacitor 39. The chokes of the different cells are slightly magnetically coupled together. It is known to design these cells and their number to obtain a desired pulse shape. What is important here is the time during which said pulse allows the passage of a current, whose intensity exceeds the charging intensity $I_{ch}$. By comparing FIG. 2b with FIG. 3, it can be seen that this improvement leads to a gain on the energy needlessly dissipated by thyristor 30. The needlessly dissipated energy approximately correspond to the surface separating curves $I_{ch}$ and $I_i$. These surfaces are hatched in FIGS. 2b and 3. As this needless energy would have to be stored in capacitor 15, it makes it possible to significantly reduce the values of the capacitors of the cells. Approximately the combined value of the two capacitors 39 of FIG. 4 is about a quarter of the capacitor 15 used under the same conditions in FIG. 1. This also leads to economies on thyrsitors 16 to 19, because they only have to permit the passage of a maximum current below current $I_{ic}$ referred to hereinbefore.

What is claimed is:

1. A supply circuit for an X-ray emitter for use in radiology, comprising:

a transformer having a primary circuit connected to a three-phase power supply, a secondary circuit connected to the emitter and controlled switch means for placing said primary circuit in and out of operation, said switch means having a set of closing thyristor means for closing said primary circuit and consequently putting into operation the supply circuit said switch means also having a correctly charged capacitor connectable to said primary circuit for reversing the flow direction of the current into the set of closing thyristors, in order to open the switch means and consequently stop the supply, said set of closing thyristors comprising at least one thyristor; and a circuit for reversing the polarity of the charge which said capacitor supplies to said switch means.

2. A circuit according to claim 1, wherein, the reversing circuit has a circuit bridge comprising second switch means, said bridge having two branches connected in parallel at their ends to the terminals of the set of thyristors, each branch is composed of two half-branches, and the capacitor being directly connected to the centres of these two branches.

3. A circuit according to claim 2, wherein, each branch has two thyristors connected in series on both sides of the center of said each branch.

4. A circuit according to claims 2 or 3, wherein, the second switch means are located in a half-branch of each branch of the reversing circuit, where the half-branches, which contain the second switch means, are not connected at a common end, and the second switch means are simultaneously manipulated.

5. A circuit according to one of the claims 1 to 3, wherein, it has means for charging the capacitor.

6. A circuit according to one of the claims 1 to 3, wherein, the capacitor is in series with a choke.

7. A circuit according to one of the claims 1 to 3, wherein, the capacitor has a group of choke-capacitor cells connected in series with one another.

8. A circuit according to claim 7, wherein, the group of cells consists of two cells.

* * * * *